US005357841A

United States Patent [19]

Clark et al.

[11] Patent Number: 5,357,841

[45] Date of Patent: Oct. 25, 1994

[54] RECOILLESS PROJECTILE LAUNCHER

[75] Inventors: Robert O. Clark, Tonbridge; Michael J. Hinton, Maidstone; Russell Meddes, Snodland, all of United Kingdom

[73] Assignee: The Secretary of State for Defence in Her Britannic Majesty's Government of the United Kingdom of Great Britain and Northern Ireland, Hants, England

[21] Appl. No.: 90,177

[22] PCT Filed: Mar. 3, 1992

[86] PCT No.: PCT/GB92/00373

§ 371 Date: Jul. 19, 1993

§ 102(e) Date: Jul. 19, 1993

[87] PCT Pub. No.: WO92/16808

PCT Pub. Date: Oct. 1, 1992

[30] Foreign Application Priority Data

Mar. 18, 1991 [GB] United Kingdom ..... 9105692.9

[51] Int. Cl.[5] ..... F41A 1/10

[52] U.S. Cl. ..... 89/1.701; 89/1.703

[58] Field of Search ..... 89/1.7, 1.701, 1.702, 89/1.703, 1.704, 1.705

[56] References Cited

U.S. PATENT DOCUMENTS

| | | | |
|---|---|---|---|
| 3,476,048 | 11/1969 | Barr et al. | 102/399 |
| 3,490,330 | 1/1970 | Walther | 89/1.7 |
| 3,771,417 | 11/1973 | Schnabele et al. | 89/1.7 |
| 4,643,071 | 2/1987 | Baechler et al. | 89/1.705 |
| 4,676,136 | 6/1987 | Kälin | 89/1.703 |
| 4,759,430 | 7/1988 | Kälin | 89/1.701 |

FOREIGN PATENT DOCUMENTS

| | | |
|---|---|---|
| WO89/04451 | of 1989 | European Pat. Off. . |
| 2352483 | of 1973 | Fed. Rep. of Germany . |
| 3002285 | of 1981 | Fed. Rep. of Germany . |
| 465442 | of 1968 | Switzerland . |
| 1346555 | of 1974 | United Kingdom . |
| 1576366 | of 1980 | United Kingdom . |
| 2186956 | of 1987 | United Kingdom . |
| 2183800 | of 1989 | United Kingdom . |

*Primary Examiner*—David Brown
*Attorney, Agent, or Firm*—Nixon & Vanderhye

[57] ABSTRACT

A projectile launcher and in particular a mass/counter-mass projectile launcher in which the piston intercept(s) comprises a braking collar (8) made of a material which exhibits constrained progressive crushing. When a projectile (18) is fired the launching piston (10) impacts upon the braking collar (8) at the muzzle of the launcher and initiates constrained progressive crushing in the collar (8). The crushing of the collar (8) absorbs the kinetic energy of the piston (10) thus arresting the axial motion of the piston (10). The projectile launcher according to the present invention can be less massive than similar launchers that use conventional metal piston intercepts which is an advantage if the launcher is designed to be shoulder-launched by a human operator. The type of collar material preferably used is made of a solid filler embedded in a plastics matrix and in particular the solid filler is made of reinforcing fibers.

17 Claims, 7 Drawing Sheets

RECOILLESS PROJECTILE LAUNCHER

BACKGROUND OF THE INVENTION

1. Field of the Invention

This invention relates to a projectile launcher and in particular to a hand-held shoulder-launched recoilless mass/countermass projectile launcher.

DISCUSSION OF THE PRIOR ART

One type of known projectile launcher comprises a launch tube with a forward open end at which a piston intercept is located. A cylindrical piston is slideably located within the launch tube and a sub-calibre projectile is supported in the launch tube on the surface of the piston facing said open end. In operation the piston and the projectile supported thereon are propelled along the launch tube towards the said open end, where the piston is halted by the piston intercept. The sub-calibre projectile passes through the intercept and is thereby launched.

Known recoilless mass/countermass projectile launchers operate by simultaneously firing a projectile in one direction and a countermass in an opposite direction with equal and opposite momentum. This prevents any recoil from being transmitted to the launcher, and thus allows the launcher to be hand-held when fired. In such systems the sub-calibre projectile is piston launched as described above and the countermass comprises either a solid block that is also piston launched or propellant gases which are forced through a rearwardly facing nozzle.

Piston intercepts are therefore designed to restrain the piston in the launch tube, while allowing the projectile to be launched unhindered.

The simplest piston intercept known in prior art launchers comprises a hollow cylindrical collar which fits slideably within the launch tube and is secured inside the muzzle. The internal diameter of the collar is sufficiently large to allow the sub-calibre projectile to pass through it. Such collars are either threadedly connected to the muzzle or constitute part of the launch tube itself. The collars are made from metal, usually steel, and plastically deform in the act of arresting the piston. In this manner the kinetic energy of the piston is dissipated and the piston is restrained inside the launch tube. Examples of such piston intercepts are disclosed in United Kingdom Patents numbered CAB 2 183 800, GB 1 346 555 and GB 1 576 366.

More sophisticated piston intercepts are known in the prior art. However all such intercepts are made of deformable metals and work on the principle that the kinetic energy of the piston will be absorbed by the deformation of the intercept. One such intercept is disclosed in United Kingdom Patent GB 2,186,956 and comprises a metal braking collar which has circumferential groves provided in it to facilitate its lengthwise compression with consequent absorbtion of energy from the piston.

Such deformable metal intercepts have several disadvantages associated with them. Firstly the load required to plastically deform a metal progressively increases as plastic deformation occurs. Consequently a high peak load will be transmitted to the launcher by a metal intercept near the end of the piston arresting process (see FIG. 7B). For this reason the launch tube, piston intercepts and pistons have to be strong enough to withstand these peak loads which results in an unnecessarily heavy launcher. This is a disadvantage if the launcher is designed to be shoulder-launched by a human operator. A second disadvantage is that known deformable metal collars have a tendency to buckle radially inwards during braking and may come into contact with the moving projectile. When this happens the projectile can be substantially decelerated. deflected from its path or in extreme cases the rearward end of the projectile can be sheared off.

SUMMARY OF THE INVENTION

The present invention seeks to overcome at least some of the aforementioned disadvantages by providing a projectile launcher which can be successfully shoulder-launched by a human operator.

According to a first aspect of the present invention there is provided a projectile launcher, comprising:

a launch tube open at one end, a piston slideably located within the launch tube for thrusting a projectile out of the open end of the launch tube, a braking collar, coaxially located within the launch tube between the piston and the open end of the launch tube so that it is constrained over its external surface against radially outward movement, for arresting axial motion of the piston during projectile launch, and a braking collar support means which is engageable with the braking collar at the open end of the launch tube, characterised in that the material from which the braking collar is made undergoes progressive crushing by a progression of local stress fractures to arrest axial motion of the piston.

When the collar undergoes progressive crushing as it arrests the axial motion of the piston during projectile launch, it is constrained against radially outward movement over its external surface and so this progressive crushing shall be referred to herein as constrained progressive crushing.

By employing a piston intercept comprising a braking collar which absorbs the kinetic energy of the piston by constrained progressive crushing the peak load transferred to the launch tube during the braking of the piston can be reduced. This is because once constrained progressive crushing has been initiated the load required to maintain crushing is substantially uniform. The progressive crushing occurs locally and then progresses through the collar in a crushing front. The reduction of the peak load transferred to the launch tube during projectile launch can allow a reduction in the strength and thus the mass of the launch tube, piston intercepts and pistons, which is an advantage for a projectile launcher which is shoulder-launched. Furthermore, during the braking of the piston the collar is crushed into tiny fragments, therefore as the projectile is launched there is no tendency for the collar to buckle radially inwards and disrupt the passage of the projectile.

Preferably the collar is made of a material which, when configured in the shape of a collar, absorbs between 50 joules and 250 joules if energy per $cm^3$ during constrained progressive crushing when tested in axial compression at a compression rate of about 5 mm per minute. If the collar material absorbs less energy than 50 joules per $cm^3$, then a large amount of collar material is required to absorb the kinetic energy of the piston. This can lead to the collar having a long axial length which is a disadvantage because it will reduce the length of the piston stroke, or it can lead to the collar having a large thickness which is a disadvantage because it will reduce the diameter of the projectile that can be launched. If the collar material absorbs more energy than 250 joules per $cm^3$ then the load required to initiate and maintain constrained progressive crushing becomes unacceptably high.

In an especially preferred embodiment of the present invention the collar material is made of a solid filler embedded in a plastics matrix. A collar made from such a material will have good constrained progressive crushing properties because the interfaces between the solid filler and the plastics matrix provide weaknesses at which fractures occur thus propagating the crushing front. Such a collar is also relatively cheap and simple to manufacture. The plastics matrix can be any thermosetting composition or thermo-plastic composition, for example epoxy resin, polyester resins, phenolic resins, polypropylene or polyethersulphone.

In one preferred embodiment of the present invention the solid filler is made of reinforcing fibres. Most high strength and stiffness and low density fibres can be used as the solid filler in the collar material, for example glass fibres, aramid fibres (e.g. kevlar), carbon fibres, polyamide fibres (e.g. nylon) and polyethylene fibres. The fibre volume fraction of the collar material, i.e. the percentage ratio of the fibre volume in the collar material to the volume of the collar material, is preferably between 20% and 80%. If the fibre volume fraction is more than 80% it becomes difficult to obtain an even distribution of plastics matrix between the fibres when making the collar. An uneven distribution of plastics matrix can lead to the production of an uneven crushing front when the collar is crushed which will cause variations in the load required to maintain crushing, and thus variations in the load transmitted to the launch tube when a projectile is launched. If the fibre volume fraction is below 20% the amount of energy absorbed by the collar material is unacceptably low. More preferably the fibre volume fraction is between 40% and 65%.

Preferably the reinforcing fibres are configured within the collar such that the fibres contribute to both the axial and circumferential strength of the collar material. This can be achieved by arranging at least two alligned arrays of fibres within the collar so that they are oriented in different directions. If the fibres are all oriented in a predominantly axial direction, thus providing mainly axial strength, then the collar is likely to split in the axial direction when it is axially compressed, instead of crushing. If the fibres are all oriented in a predominantly circumferential direction, thus providing mainly circumferential strength, then the collar collapses under axial compression absorbing only a small amount of energy. Therefore, for the collar to perform well a balance must be provided in the collar between fibres predominantly axially directed and fibres predominantly circumferentially directed.

In one especially preferred embodiment the reinforcing fibres are configured within the collar in at least one annular layer of woven cloth. This configuration of the reinforcing fibres within the collar provides a good distribution of interfaces between the fibres and the matrix which increases the uniformity of the load required to maintain constrained progressive crushing. This reduces variations in the load transferred to the launch tube during the launch of the projectile.

The cloth can be woven in different ways, standard weave and satin weave are two examples but many others can be used successfully. Also the angle between the warp and the weft of the cloth can be varied.

Alternatively the reinforcing fibres can be configured within the collar in a non-woven angle plied arrangement. In this arrangement a fibre is wound coaxially and helically along the length of a cylindrical frame in a first fibre layer. Then the fibre is wound coaxially and helically in the opposite direction back along the length of the cylindrical frame and over the first fibre layer, the helical pitch angle of the second fibre layer being oppositely directed to the helical pitch angle of the first fibre layer. The layers of fibre are embedded in a plastics matrix either by wet winding or by using fibres that are pre-impregnated with matrix material. Several layers of fibre can be configured in this way within the collar.

Preferably the average thickness of the collar is from 0.01 to 0.05 times the external diameter of the collar. If the thickness of the collar is less than 0.01 times the external diameter, the collar is likely to buckle and snap instead of crushing progressively. If the thickness of the collar is more than 0.05 times the external diameter, the load required to initiate and maintain constrained progressive crushing becomes unacceptably high.

In one especially preferred embodiment the annular cross-sectional area of the collar is reduced in a longitudinal region of the collar. Therefore in compression the stress in the collar is highest in the region of reduced cross-sectional area and so progressive crushing will be initiated in this region. This feature is an advantage because it reduces the load required to produce the level of strain in the collar which initiates constrained progressive crushing and so the peak load transferred to the launch tube during projectile launch can be reduced.

In one embodiment this reduction in cross-section is realised by providing a plurality of cut out regions in one of the anular end surfaces of the collar and in a further embodiment the said cut out regions are substantially triangular. In yet another embodiment the reduction in cross-section is realised by tapering the collar over at least part of its axial length. In a further embodiment the said taper is truncated at one end of the collar and the truncated end surface of the collar extends over between 20% and 80% of the thickness of the collar. The truncated end surface provides a contact surface between the collar and the piston or the collar support means at which crushing can be initiated. In another embodiment the truncated taper comprises an internal or external chamfer.

Preferably the longitudinal region in the collar of reduced cross-sectional area is located at the end of the collar which engages the piston. This is because if the progressive crushing of the collar is initiated at the end of the collar that engages the supporting ring then the tiny fragments of collar produced can effect the projectile as it is launched. If the progressive crushing is initiated in the end of the collar which engages the piston then the tiny fragments flow into the space between the piston and the projectile that is created as soon as the piston is decelerated and therefore do not effect the projectile.

Preferably the surface of the piston which engages the collar comprises a substantially planar anular circumferential rim, the thickness of which is at least the thickness of the collar. The planar anular circumferential rim of the piston provides a surface that engages uniformly with the collar as the piston is arrested and produces uniform axial compression throughout the collar so that the collar crushes substantially uniformly and thus absorbs the kinetic energy of the piston substantially uniformly.

According to a second aspect of the present invention there is provided a recoilless mass/countermass projectile launcher, comprising:

(a) a hollow cylindrical launch tube open at its forward and rearward ends, (b) two cylindrical pistons located within the launch tube at a mid-region thereof configured in a back-to-back relationship, (c) a propellant means located between the said pistons, (d) a forward braking collar, located within the launch tube between the forward facing piston and the open forward end of the launch tube so that it is constrained against radially outward movement, for arresting the axial travel of the forward facing piston during projectile launch, (e) a forward braking collar support means which is engageable with the forward braking collar at the open forward end of the launch tube, (f) a rearward braking collar, located within the launch tube between the rearward facing piston and the open rearward end of the tube so that it is constrained against radially outward movement, for arresting the axial travel of the rearward facing piston during projectile launch, and (g) a rearward braking collar support means which is engageable with the rearward braking collar at the open rearward end of the launch tube, characterised in that the material from which the forward and rearward braking collars are made undergoes progressive crushing by a progression of stress fractures to arrest axial motion of the respective pistons.

The second aspect of the invention has all of the advantages described above in relation to the first aspect of the invention. However, because the second aspect of the invention has collars that exhibit constrained progressive crushing at both ends of the launch tube, the weight saving is doubled. Also, because collars that exhibit constrained progressive crushing absorb energy substantially uniformly once crushing has been initiated, the pistons ape decelerated at substantially the same rate at both ends of the launch tube. Therefore the recoil transmitted to the launch tube when a projectile is launched is reduced compared to the recoil produced in launchers that have conventional metal collars because conventional metal collars absorb energy much less uniformly.

It is preferable that the collar at the rearward end of the launch tube is not tapered on its external surface at the end of the collar that engages the piston. This is because if the countermass is made of a dispersable material, such as a flaky material, then it can become caught between the external surface of the collar and the internal surface of the launch tube when the countermass is launched and this can force the collar to buckle inwardly. A taper on the internal surface of the collar is preferred.

BRIEF DESCRIPTION OF THE DRAWINGS

Embodiments of the present invention will now be described by way of example only with reference to the accompanying drawings in which.

DETAILED DISCUSSION OF PREFERRED EMBODIMENTS

Figure 1:
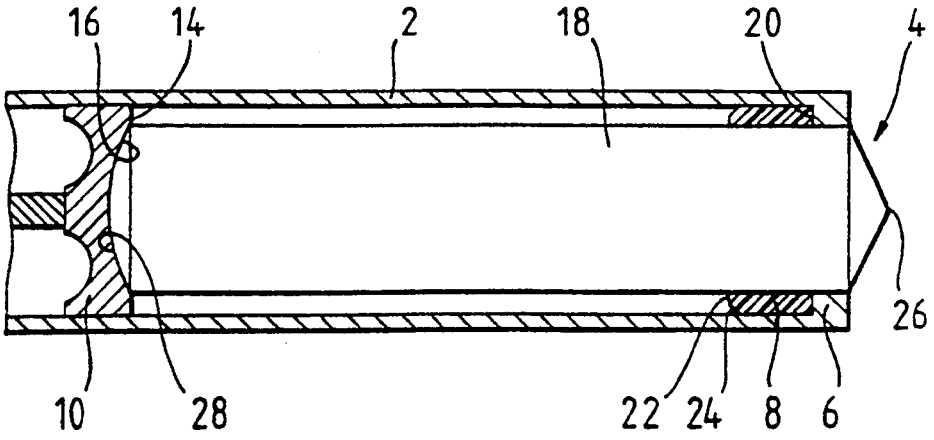
FIG. 1 is a longitudinal section of the forward end of a projectile launcher containing a braking collar according to the first aspect of the present invention.
Figure 2:
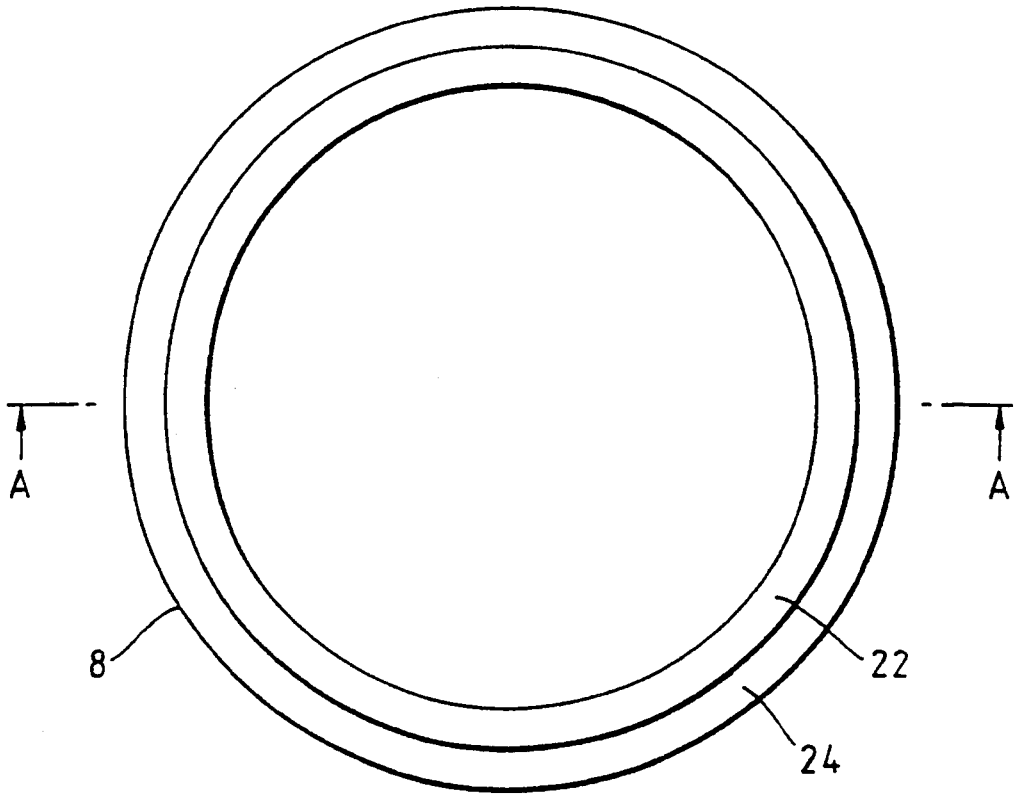
FIG. 2 is an end view of the braking collar illustrated in FIG. 1 as seen from the centre of the launcher.
Figure 3:
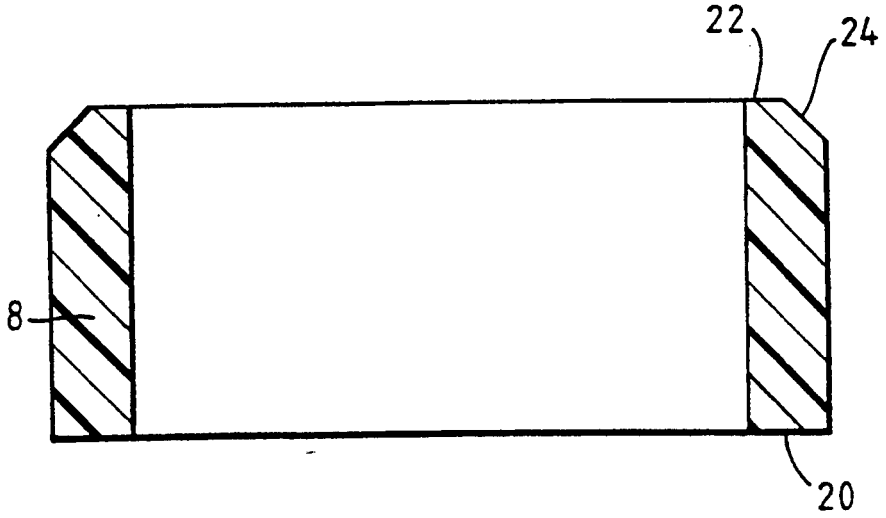
FIG. 3 is a longitudinal section along line "AA" in FIG. 2.

One embodiment of the projectile launcher according to the first aspect of the present invention will now be described with reference to FIGS. 1, 2, 3, 5B and 10.

The launcher comprises a hollow cylindrical launch tube 2 with an open forward end 4. A section of the launch tube 2 at the open end 4 has an internal diameter which is less than that of the body of the launch tube. This section forms a supporting ring 6 for a braking collar 8 which is located slideably within the launch tube 2 between the supporting ring 6 and a piston 10. The internal diameters of the collar 8 and the supporting ring 6 are the same, being great enough to allow a projectile 18 to pass through them unhindered. The collar 8 has a plane annular end surface 20 supported by and cemented to the supporting ring 6 and at its other end a chamfered end surface comprising an internal plane rim 22 which is half the thickness of the collar and an external sloping region 24 oriented at 45° to the central axis of the collar (see FIG. 5B).

Figure 5A:
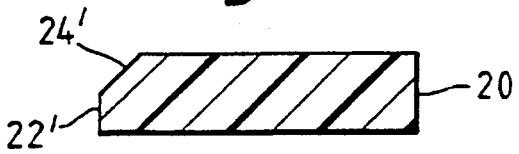
FIGS. 5A to 5C are sections through a single wall of modified braking collars suitable for use in the projectile launchers illustrated in FIG. 1 and FIG. 4.
Figure 5B:
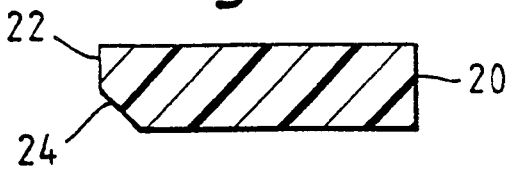
Figure 5C:
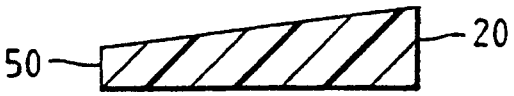
Figure 6:
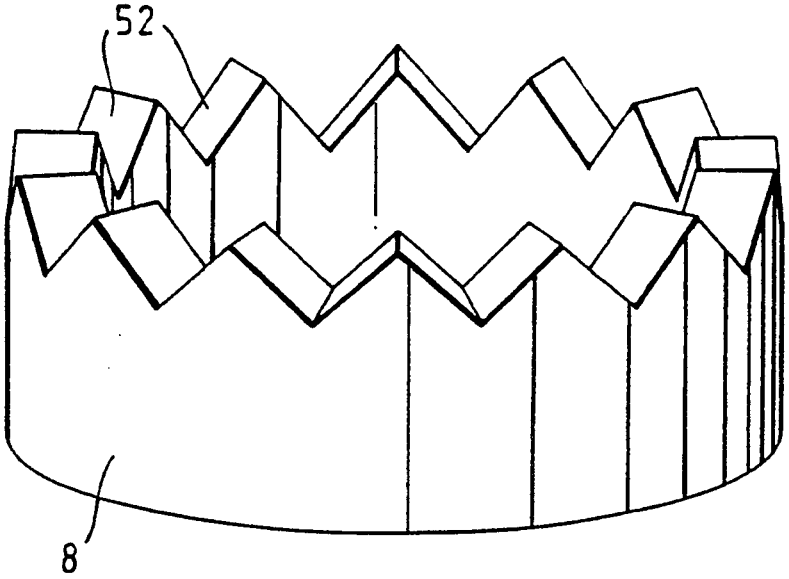
FIG. 6 is a perspective view of a further modified braking collar suitable for use in the projectile launchers illustrated in FIG. 1 and FIG. 4.

Alternatively the collar 8 could be configured with reference to FIGS. 5A, 5C or 6. The collar shown in FIG. 5A has a plane annular end surface 20 and at its other end a chamfered end surface comprising an external plane rim 22' which is half the thickness of the collar and an internal sloping region 24' oriented at 45° to the central axis of the collar. The collar shown in FIG. 5C has an internal taper over its entire length, the annular end surface 20 being twice the thickness of the annular end surface 50. The collar shown in FIG. 6 has an annular end surface 20 and at its other end surface the collar has a plurality of substantially triangular teeth 52 cut into it. The collars shown in FIGS. 5A, 5C and 6 are configured inside the launch tube in the same way as the collar shown in FIG. 5B as describe above.

The surface of the piston 10 that faces the open forward end 4 of the launch tube 2 comprises a central concave region 16 and a plane circumferential rim 14 the thickness of which is at least the thickness of the collar 8. The projectile 18 is a right cylinder which fits slideably through the collar S and supporting ring 6 wish a forward pointed end 26 and a rearward convex end 28. The rearward convex end 28 of the projectile 18 is supported on the central concave region 16 of the piston 10 with the forward end of the projectile 18 being supported by the collar 8 and supporting ring 6.

The thickness of the collar 8 is approximately 0.03 times the external diameter of the collar, and the axial length of the collar is approximately 0.5 times the external diameter of the collar. The axial length of the collar should be chosen so that a region of the collar remains uncrushed after the piston has been arrested.

Figure 11:
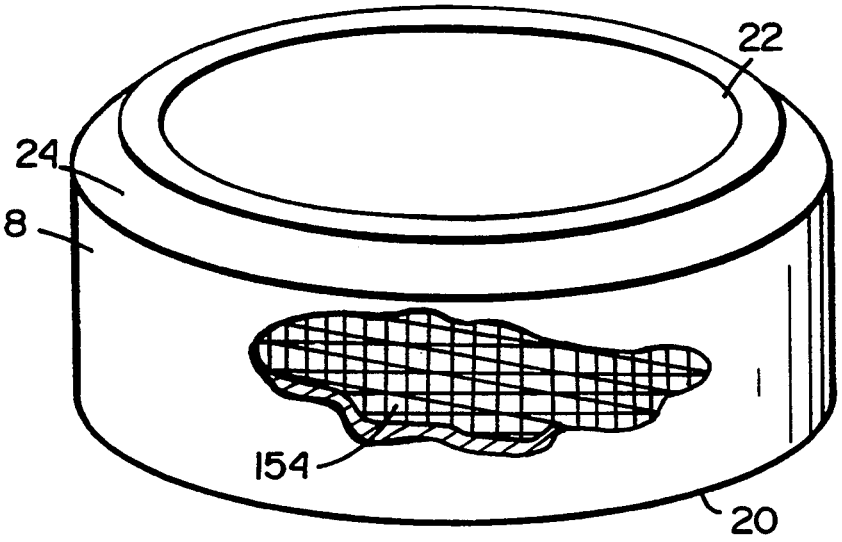
FIG. 11 is a perspective view of the braking collar illustrated in FIG. 1 with a cut out portion showing the configuration of a non-woven angle plied arrangement of fibers within the collar.

The collar 8 is composed of several anular layers of glass fibre cloth embedded in an epoxy resin matrix such that the fibre volume fraction is 50%. The cloth is of standard weave with the warp of the cloth being substantially perpendicular to the weft of the cloth and the cloth is oriented within the collar with either the warp or the weft of the cloth substantially axially directed, this is shown in the cut out portion 54 of FIG. 10. The fibres within the cloth may alternatively comprise carbon fibres, aramid fibres (e.g. Kevlar), polyamide fibres (e.g. nylon), or polyethylene fibres. Alternatively the fibre cloth can be of satin weave and also the angle between the warp and the weft can he varied. As an alternative to the fibre cloth, a non-woven angle plied arrangement can be used as shown in the cut out portion 154 of FIG. 11, in this arrangement the fibre is filament wound either by wet winding or by using fibres pre-impregnated with matrix material, as is well known in the art. Alternatively individually stacked fibres can be used either in a unidirectional or randomly oriented configuration. Alternative matrix materials include polyester resins, phenolic resins, polypropylene and polyethersulphine.

In operation, propellant gases generated behind the piston 10 propel it and its associated projectile 18 towards the open end 4 of the launch tube 2. The projectile 18 passes unhindered through the collar 8 and supporting ring 6 and is thereby launched from the open end 4 of the launch tube 2, whereas the piston 10 is arrested by the collar 8 and so is restrained within the launch tube 2. The plane circumferential rim 14 of the piston 10 impacts on the plane rim 22 of the chamfered end of the collar 8. Because stress in the collar is highest at the chamfered end due to the reduced cross-sectional area of the collar in this region progressive crushing in the collar 8 is initiated at said chamfered end. The tiny fragments produced when the collar crushes flow into the space created between the projectile 18 and the piston 10. The supporting ring 6 is strong enough to withstand the peak load transmitted to it from the collar 8 during the braking of the piston 10 without deforming. The kinetic energy of the piston 10 is absorbed by the constrained progressive crushing of the collar 8 against the supporting ring 6 thus arresting the piston 10 and restraining it within the launch tube 2.

Figure 4:
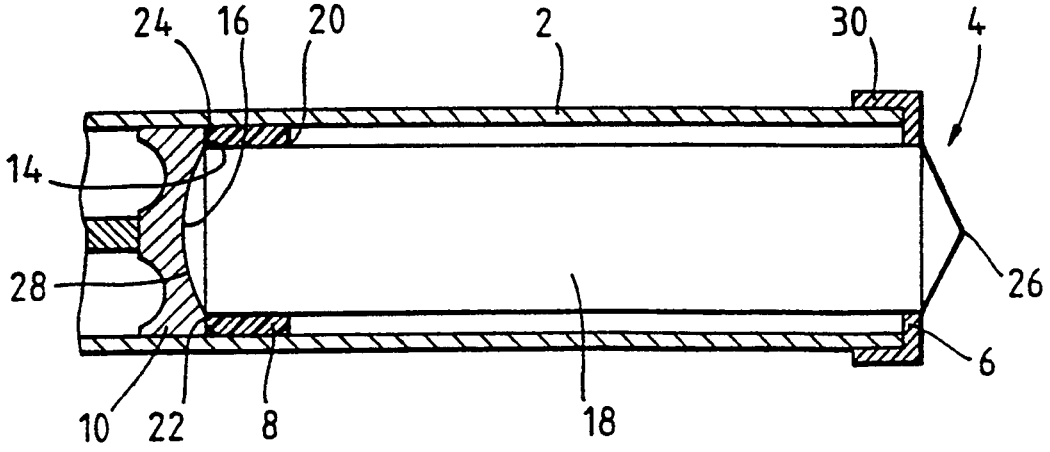
FIG. 4 is a variation to the embodiment shown in FIG. 1.

In the variation illustrated in FIG. 4 the plane rim 22 of the chamfered end of the collar 8 (see FIG. 5B) is supported by and cemented to the plane circumferential rim 14 of the piston 10, and the supporting ring 6 is detachable from the launch tube 2. The detachable section comprises the ring 6 with an internal diameter equal to the internal diameter of the collar 8 and an external diameter greater than the external diameter of the launch tube 2. The ring 6 has a circumferential sleeve 30 with which the ring is secured over the open end 4 of the launch tube 2 by a cemented or a screw threaded joint at the interface between the external surface of the open end 4 of the launch tube 2 and the internal surface of the circumferential sleeve 30. The embodiments of the collar shown in FIGS. 5A, 5C, and 6 can be used in the variation illustrated in FIG. 4 as an alternative to the collar shown in FIG. 5B. In each case the end surface opposite to the end surface 20 is cemented to the plane circumferential rim 14 of the piston 10.

In operation, the piston 10, collar 8 and projectile 18 are propelled towards the open end 4 of the launch tube 2. When the plane annular end surface 20 of the collar 8 impacts on the supporting ring 6 constrained progressive crushing is initiated at the chamfered end of the collar 8. Again the kinetic energy of the piston 10 is absorbed by the constrained progressive crushing of the collar 8 against the supporting ring 6.

The geometry of the collar 8 is one of the factors that determines the characteristic way the collar 8 progressively crushes, the other factor being the materials from which the collar 8 is made. The constrained progressive crushing of the collar 8 is characterised by the variation of the load experienced by the collar with the axial length of the collar through which crushing has occurred. Schematic graphs displaying the constrained progressive crushing characteristics of several different collar geometries and compositions are depicted in FIGS. 7A to 7E. In FIGS. 7A to 7E the axial compression D of the collar is shown along the horizontal axis and the load L experienced by the collar is shown along the vertical axis. The shaded areas under the graphs in 7A and 7E represent the amount of energy that must be absorbed to arrest a given piston.

Figure 8:
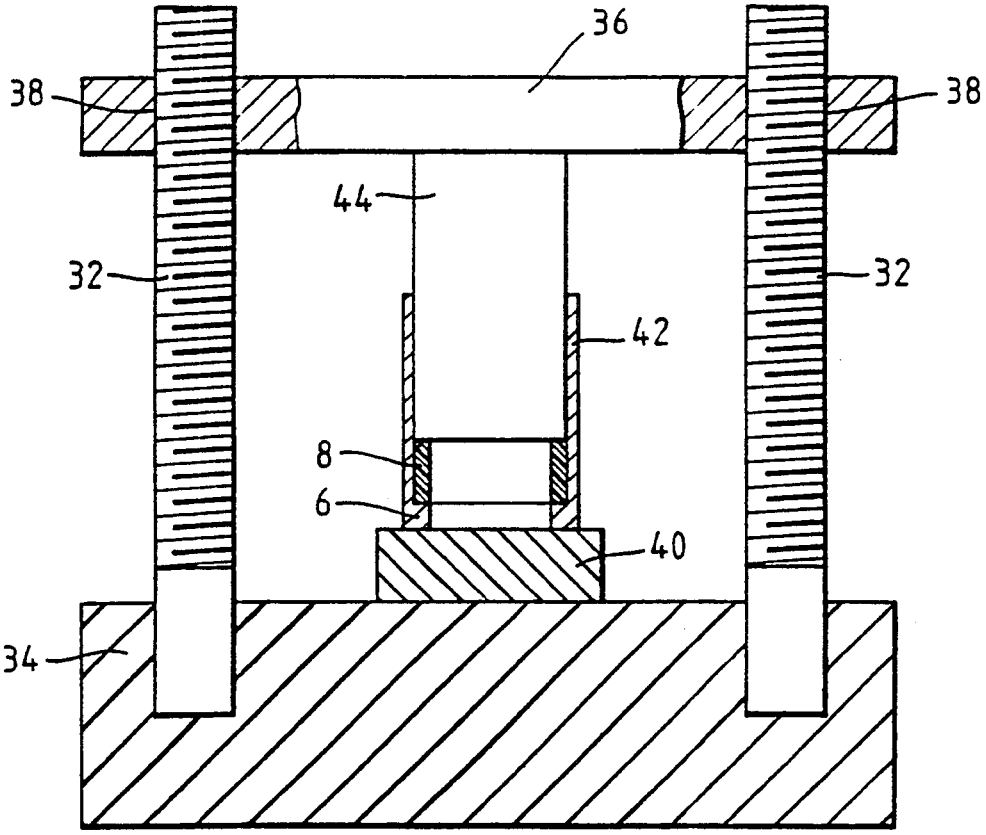
FIG. 8 is a longitudinal section of the apparatus used to assess the constrained progressive crushing characteristics of a sample braking collar.
Figure 10:
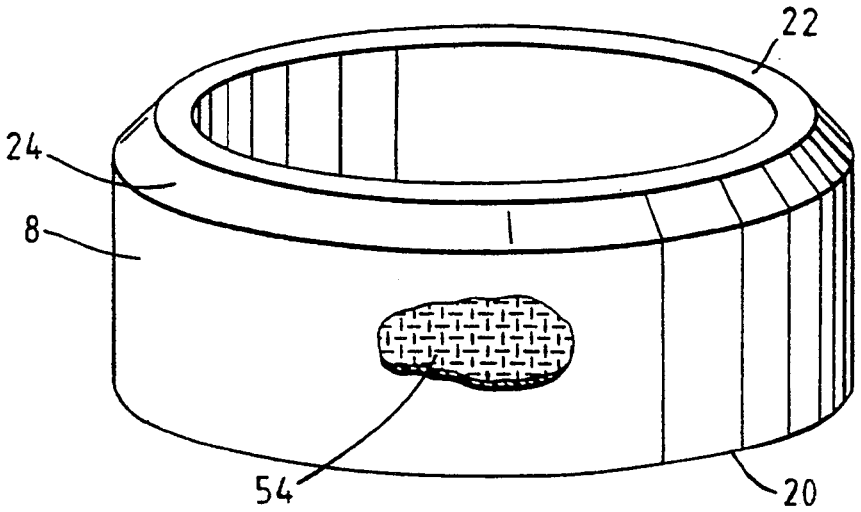
FIG. 10 is a perspective view of the braking collar illustrated in FIG. 1 with a cut out portion which shows the configuration of a single layer of fibre cloth within the collar.

The apparatus shown in FIG. 8 can be used to measure the constrained progressive crushing characteristic of a sample collar 8. The apparatus comprises a rigid horizontal base 34 in which two vertical screw threaded cylindrical members 32 are secured at their lower ends such that the members can be rotated about their vertical axes. The members 32 can be rotated mechanically and are connected by a gear mechanism (not shown) so that both members rotate in the same direction and at the same rate. A rigid cross plate 36 has two holes 38 bored through it for the location of the upper ends of the vertical members 32. The holes 38 are screw threaded so that when the vertical members 32 are rotated the position of rigid cross plate 36 changes relative to the members 32. A load cell 40 is located on the base 34. A tube 42 identical to the launch tube 2 is positioned with one end resting on the load cell 40. The tube 42 has a supporting ring 6 at said one end. The sample collar 8 to be tested is slideably located within the tube 42 so that it rests upon the supporting ring 6. A solid right metal cylinder 44 with plane end surfaces is slideably located within the tube 42 so that its lower plane end surface just rests upon the sample collar 8. The cylinder 44 is axially longer than the tube 42. The position of the plate 36 is then adjusted by rotating the members 32 so that the plate just rests upon the upper plane end surface of the cylinder 44. The reading displayed by the load cell is zeroed and the position of the plate 36 is noted.

The vertical members 32 are then rotated uniformly so that the plate 36 moves towards the rigid base 34 at a uniform rate of approximately 5 mm a minute. The metal cylinder 44 is pushed downwards thus applying a load onto the collar 8 which undergoes constrained crushing. The load acting on the collar 8 is transmitted to the tube 42 via supporting ring 6 and hence to the load cell 40. The distance through which the plate 36 moves and the load displayed by the load cell 40 are recorded throughout the crushing of the sample collar 8.

The distance through which the plate travels (D) is then plotted against the load (L) displayed by the load measuring means 40 to produce a graph characteristic of the constrained crushing of the sample collar 8. The energy absorbed during the crushing of the collar is represented by the energy under the graph and hence the energy absorbed per $cm^3$ of the collar can be calculated.

Ideally the peak load (P) transferred to the launch tube 2 during the braking of the piston 10 should be as low as possible while still allowing the efficient absorption of the kinetic energy of the piston 10 by the collar 8. Furthermore there should be no abrupt changes in the load transmitted to the launch tube 2. Therefore the ideal collar would have a characteristic graph similar to that shown in FIG. 7A, with a smooth initial rise in the load which then becomes constant as the crushing of the collar progresses.

Although the testing procedure described above is quasi-static, the results relate surprisingly well to the dynamic crushing of the collar.

Figure 7A:
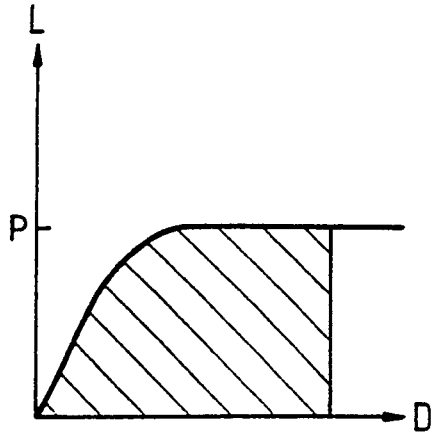
FIGS. 7A to 7E show, in schematic form, load vs displacement graphs relating to the axial crushing of different braking collar designs and compositions.
Figure 7B:
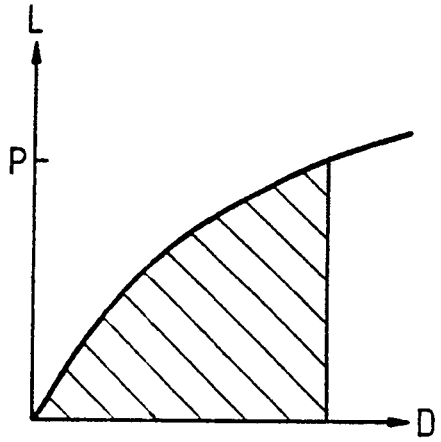

Known piston intercepts which are made of metal and absorb the kinetic energy of the piston by elastic and then plastic deformation have characteristic graphs similar to that shown in FIG. 7B. The load transferred to the launch tube increases progressively throughout the braking of the piston, which leads to very high peak loads which must be withstood by the launch tube, piston intercepts and pistons.

Figure 7C:
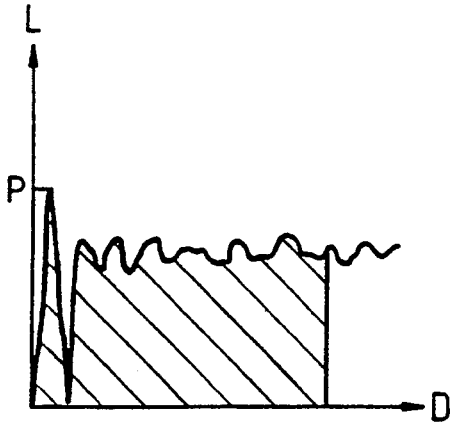

The graph shown in FIG. 7C shows a characteristic trace for the constrained progressive crushing of a filled plastic collar with no chamfer or taper. The peak load is substantially reduced compared to that recorded for a metal collar. However the large variation in the load during the initial part of the crushing process is not ideal because can cause a large variation in the load transmitted to the launch tube.

Figure 7D:
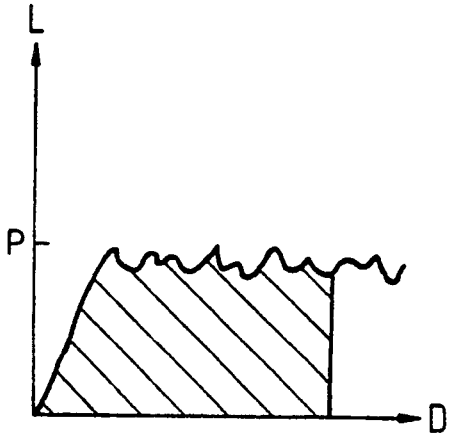

The graph shown in FIG. 7D shows a characteristic graph for the constrained progressive crushing of a filled plastic collar configured with reference to FIGS. 1, 2, 3, 4 and 5A or 5B. From a comparison of FIG. 7C with FIG. 7D it can be seen that the chamfering of the collar removes the initial peak from the graph that was recorded in FIG. 7C.

One such collar that was tested using the apparatus in FIG. 8 had an external diameter of 100 mm, a thickness of 3 mm and an axial length of 50 mm. The collar was constructed from 28 anular layers of glass fibre cloth embedded in an epoxy resin matrix with the layers of cloth uniformly spaced. The glass fibre content of the collar was 50% by volume. The fibre cloth was of standard weave with the warp of the cloth substantially perpendicular to the weft of the cloth and was oriented within the collar with either the warp or the weft of the cloth substantially axially directed (see FIG. 10). One end surface of the collar had an external chamfer over half its thickness, the chamfer being oriented at 45° to the axis of the collar, the other end surface of the collar was planar.

When tested this collar absorbed approximately 100 joules of energy per $cm^3$ of material during constrained progressive crushing and the peak load transmitted to the tube 42 was 120 KN.

Figure 7E:
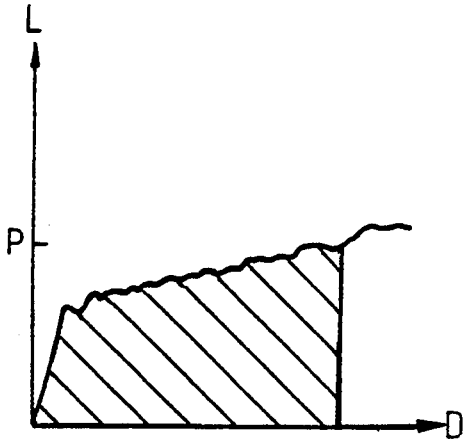

The trace shown in FIG. 7E shows a characteristic trace for the constrained progressive crushing of a filled plastic collar configured with reference to FIG. 5C. The end surface 50 faces the piston 10 and the end surface 20 Faces the supporting ring 6. As can be seen from FIG. 7E the tapering of the collar 8 produces a near ideal load displacement graph which increases gradually throughout the crushing of the collar 8.

Figure 9:
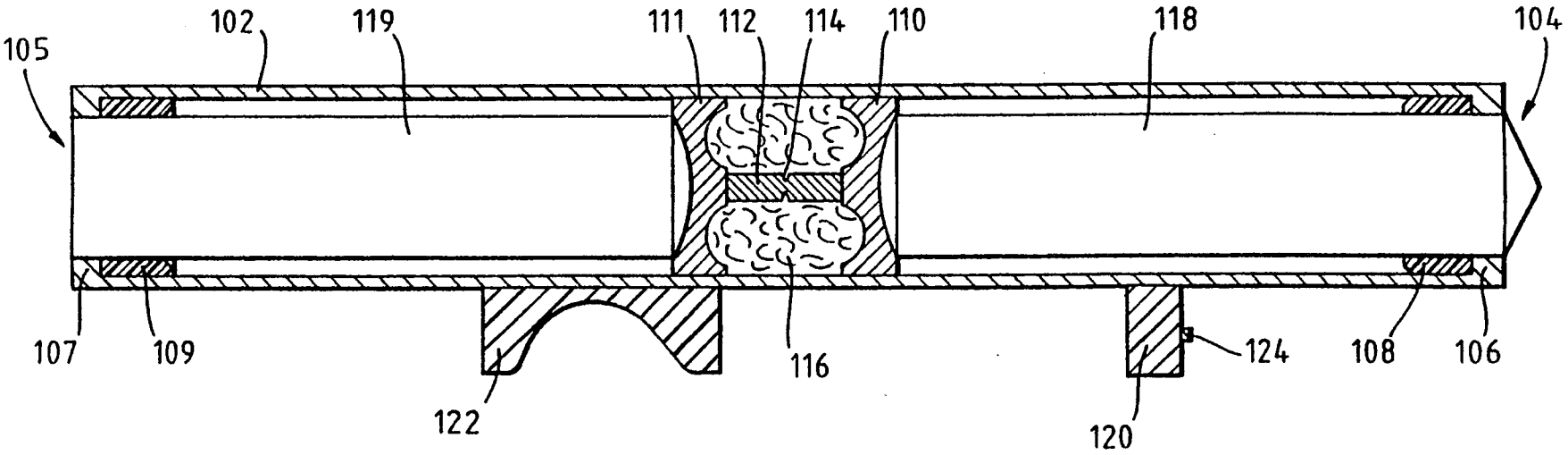
FIG. 9 is a longitudinal section of a recoilless mass/countermass projectile launcher according to the second aspect of the present invention.

FIG. 9 shows a longitudinal section of a hand-held shoulder-launched mass/countermass projectile launcher according to a second aspect of the present invention, The launcher comprises a launch tube 102 which is open at its forward end 104 and rearward end 105, Two pistons 110 and 111 are slideably located within the launch tube 102, arranged in a back-to-back relationship about the mid-point of the launch tube with piston 110 facing the forward end 104 and piston 111 facing the rearward end 105, The two pistons 110 and 111 are releasably joined together by an axially-located connecting rod 112 in which a weakness in the form of a machined circumferential groove 114 is provided. Propellant 116 is located around the connecting rod 112 in the space created between the pistons 110 and 111. A sub-calibre projectile 118 rests against the forward surface of the piston 110 and a sub-calibre countermass 119 comprising a plurality of plastic flakes connected by threads is supported against the rearward facing piston 111.

A forward braking collar 108 is glued to a forward supporting ring 106 for arresting forward facing piston 110. Similarly a rearward braking collar 109 is glued to rearward supporting ring 107 for arresting rearward facing piston 111. Collars 108 and 109 are similar to those described above with reference to FIGS. 5B and 5A respectively. The collar 109 is internally chamfered to prevent flakes of the countermass 119 from becoming jammed between the collar 109 and the launch tube 102 when the launcher is operated. Alternatively collars confirmed with reference to FIGS. 5C and 6 can be uesd.

The launch tube 102 has forward and rearward holding members 120 and 122 respectively, designed to make the launcher suitable for launching from the shoulder of a human operator. A trigger 124 is located on the forward holding member 120.

In operation the trigger 124 is pressed causing a triggering mechanism (not shown) to initiate propellant 116. The hot propellant gases generated from the ignited propellant produce a build-up of pressure in the space between the pistons 110 and 117. When the gas pressure reaches a predetermined value the connecting rod 112 yields in tension at the groove 114 causing the piston 110 and projectile 118 to be projected towards the forward end 104 of the launch tube 102 and the piston 111 and countermass 119 to be projected towards the rearward end 105 of the launch tube 102. The collar 108 arrests the piston 110 by the constrained progressive crushing of the collar against forward support ring 106 and allows the projectile 118 to leave the launch tube 102 unhindered. Simultaneously the rearward collar 109 arrests the piston 111 by constrained progressive crushing of the collar against rearward supporting ring 107 and allows the countermass 119 to leave the launch tube 102 unhindered. The hot propellant gases are safely contained in the launch tube 102 because the pistons 110 and 111 seal the open forward end 104 and open rearward end 105 respectively.

We claim:

1. A projectile launcher comprising:

a launch tube (2) open at one end (4), a piston (10) slidably located within the launch tube (2) for thrusting a projectile (18) out of the open end (4) of the launch tube (2).

a braking collar (8), coaxially located within the launch tube (2) between the piston (10) and the open end (4) of the launch tube (2) so that it is constrained over its external surface against radially outward movement, for arresting axial motion of the piston (10) during projectile launch, and a braking collar support means (6) which is engageable with the braking collar (8) at the open end (4) of the launch tube (2), wherein the braking collar (8) is comprised of a material in which increasing load causes progressive crushing by a progression of local stress fractures, said collar comprising a means for arresting axial motion of the piston.

2. A projectile launcher according to claim 1 characterised in that the average thickness of the collar (8) is 0.01 to 0.05 times the external diameter of the collar (8).

3. A projectile launcher according to claim 1 characterised in that the collar material is made of a solid filler embedded in a plastics matrix.

4. A projectile launcher according to claim 3 characterised in that the solid filler comprises reinforcing fibres.

5. A projectile launcher according to claim 4 characterised in that the fibre volume fraction of the collar material is between 20% and 80%.

6. A projectile launcher according to claim 5 characterised in that the fibre volume fraction of the collar material is between 40% and 65%.

7. A projectile launcher according to claim 3 characterised in that the reinforcing fibres are configured within the collar (8) such that the fibres contribute to both the axial strength of the collar (8) and the circumferential strength of the collar (8).

8. A projectile launcher according to claim 7 characterised in that the reinforcing fibres are configured within the collar (8) in at least one annular layer of woven cloth (54).

9. A projectile launcher according to claim 7 characterised in that the reinforcing fibres are configured within the collar (8) in a non-woven angle-plied arrangement,

10. A projectile launcher according to claim 1 characterised in that the annular cross-sectional area of the collar (8) is reduced in a longitudinal region of the collar.

11. A projectile launcher according to claim 10 characterised in that the longitudinal region of the collar is located at the end of the collar (8) which engages the piston (10).

12. A projectile launcher according to claim 10 characterised in that a plurality of cut out regions (52) are provided in one of the annular end surfaces of the collar (8).

13. A projectile launcher according to claim 12 characterised in that the plurality of cut out regions (52) are substantially triangular.

14. A projectile launcher according to claim 10 characterised in that the collar (8) is tapered over at least part of its axial length.

15. A projectile launcher according to claim 14 characterised in that the taper is truncated at one end of the collar (8) and the truncated end surface (22, 22', 50) of the collar (8) extends over between 20% and 80% of the thickness of the collar (8).

16. A projectile launcher according to claim 15 characterised in that the said truncated taper comprises an internal chamfer (22', 24') or external chafer (22, 24).

17. A recoilless mass/countermass projectile launcher, comprising:

a hollow cylindrical launch tube (102) open at its forward end (104) and rearward end (105), two cylindrical pistons (110, 111) located within the launch tube (102) at a mid-region thereof configured in a back-to-back relationship, a propellant means (116) located between said pistons (110, 111), a forward braking collar (108), located within the launch tube (102) between the forward facing piston (110) and the open forward end (104) of the launch tube (102) so that it is constrained against radially outward movement, for arresting the axial travel of the forward facing piston (110) during projectile launch, a forward braking collar support means (106) which is engageable with the forward braking collar (108) at the open forward end (104) of the launch tube (102), a rearward braking collar (109) located within the launch tube (102) between the rearward facing piston (111) and the open rearward end (105) of the tube (102) so that it is constrained against radially outward movement, for arresting the axial travel of the rearward facing piston (111) during projectile launch, and a rearward braking collar support means (107) which is engageable with the rearward braking collar (109) at the open rearward end (105) of the launch tube (102), wherein said forward braking collar (108) and the rearward braking collar (109) are comprised of a material in which increasing load causes progressive crushing by a progression of local stress fractures, said collars comprising means for arresting axial motion of the respective pistons (110, 111).

* * * * *